United States Patent [19]

Sutton

[11] 3,992,986

[45] Nov. 23, 1976

[54] APPARATUS FOR COLLECTING AND DISPOSING OF REFUSE

[76] Inventor: William H. Sutton, 7400 Smithfield Road, Fort Worth, Tex. 76118

[22] Filed: May 28, 1975

[21] Appl. No.: 581,637

[52] U.S. Cl. ..... 100/7; 61/35; 100/45; 100/49; 100/52; 100/53; 100/99; 100/100; 100/102; 100/127; 100/218; 100/220; 100/249; 100/269 R; 214/152

[51] Int. Cl.[2] ..... B65B 13/20; B30B 15/22; B30B 15/32

[58] Field of Search ..... 214/152; 100/102, 249, 100/127, 220, 218, 49, 52, 3, 8, 45, 37, 53, 99, 100, 7, 269 R; 61/35

[56] References Cited

UNITED STATES PATENTS

| | | | |
|---|---|---|---|
| 2,817,288 | 12/1957 | Peters | 100/127 X |
| 3,144,819 | 8/1964 | Riddell | 100/127 X |
| 3,490,631 | 1/1970 | Smith | 100/127 X |
| 3,513,769 | 5/1970 | Sutter | 100/112 X |
| 3,583,164 | 6/1971 | Sherrill | 100/100 |
| 3,621,775 | 11/1971 | Dedio et al. | 100/49 |
| 3,625,374 | 12/1971 | Hemphill | 100/220 X |
| 3,636,863 | 1/1972 | Woyden | 100/218 |
| 3,654,854 | 4/1972 | Cook | 100/218 X |
| 3,827,349 | 8/1974 | Gilman | 100/3 X |

*Primary Examiner*—Billy J. Wilhite
*Attorney, Agent, or Firm*—James C. Fails

[57] ABSTRACT

Method and apparatus of refuse collection in a city for disposal in a landfill characterized by the steps of sending portable collecting and baling units on routes throughout the city for collecting refuse and simultaneously baling the refuse into large bales, then periodically discharging the bales along the route. A transport unit which is capable of carrying several bales is then notified to pick up the bales and transport them to a landfill. The baling unit has a hopper collector for manually dumping the refuse, a ram for compressing the refuse within a compaction chute into a bale once the refuse fills the hopper collector. After the bale achieves a selected size, wires previously threaded through guides are tied and the bale ejected. An attached conveyor extracts the bale and carries one or two bales temporarily until at a satisfactory place along the route they are unloaded for later pickup by the transport unit.

1 Claim, 9 Drawing Figures

Fig. 1
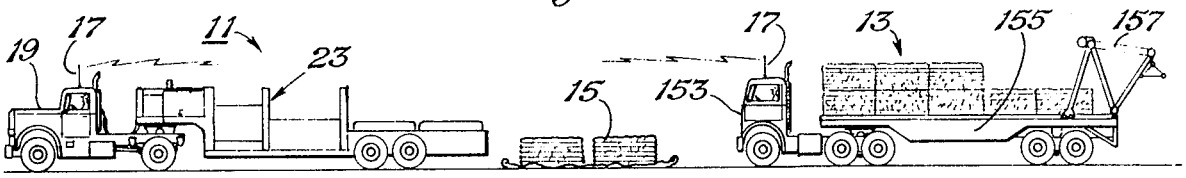
Fig. 2
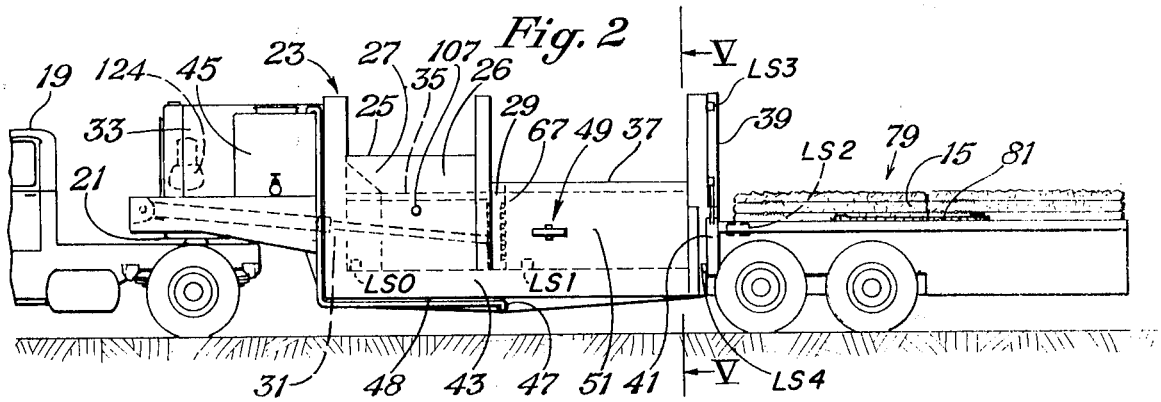
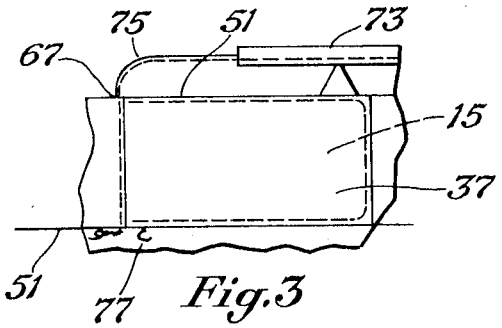
Fig. 3
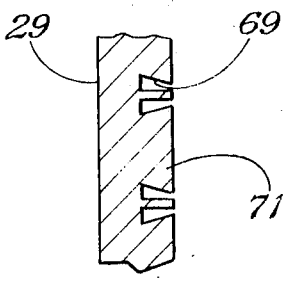
Fig. 4
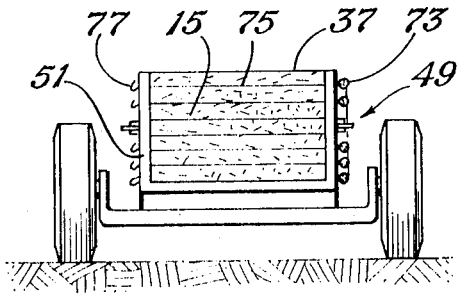
Fig. 5
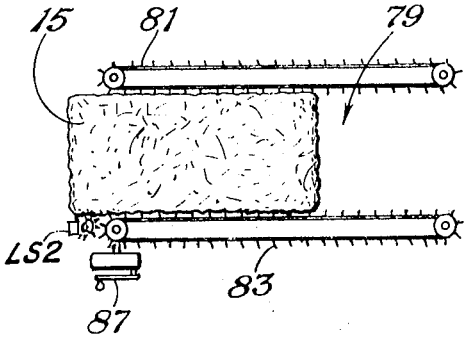
Fig. 7
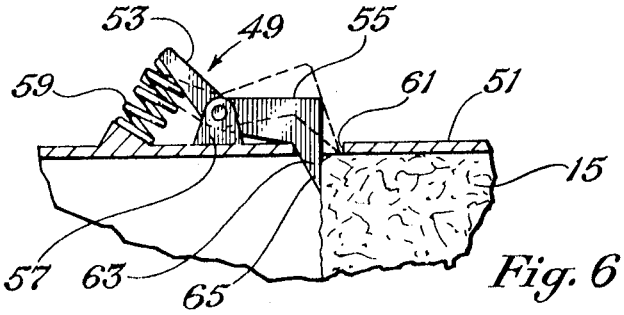
Fig. 6

Fig.8
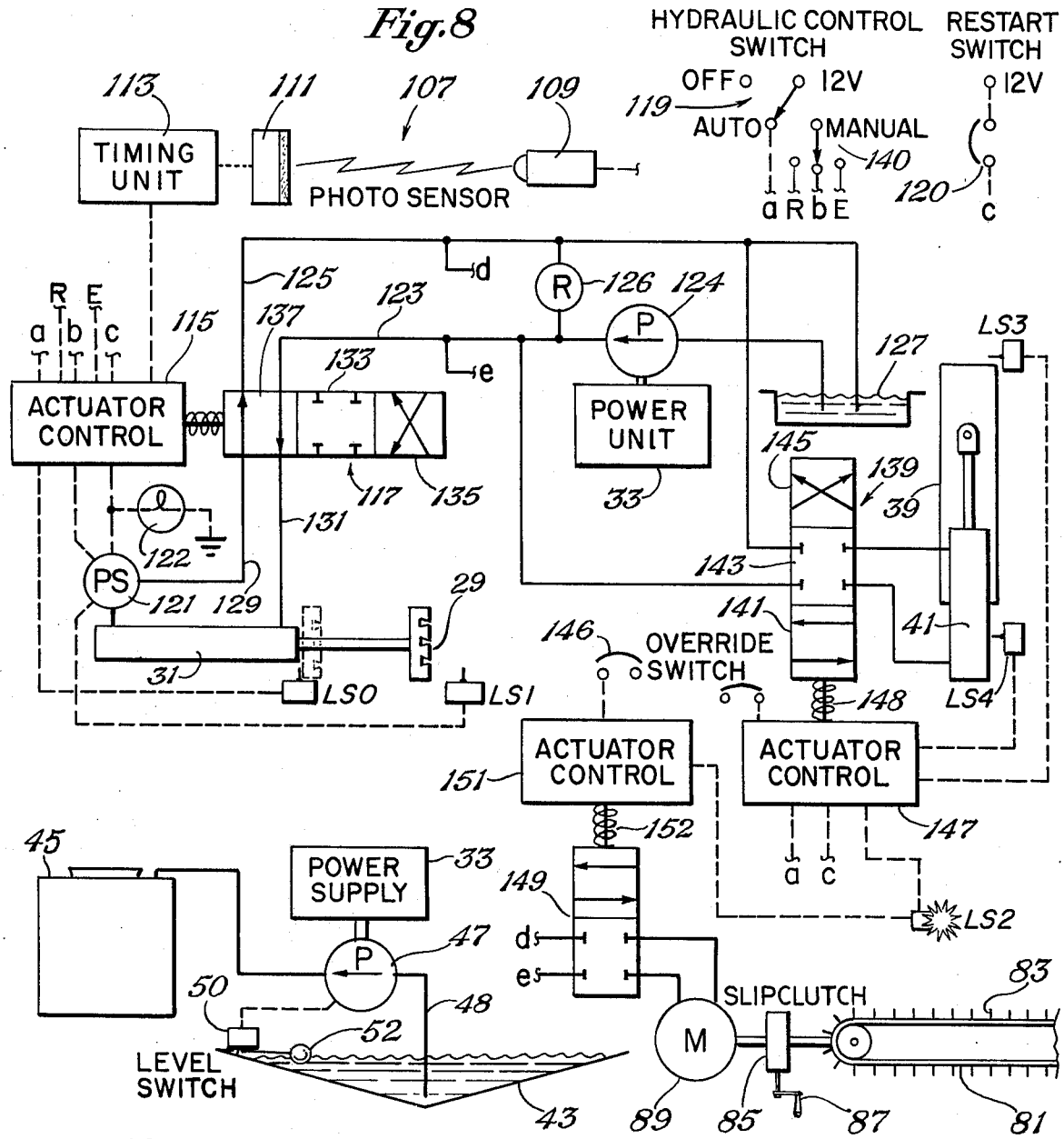
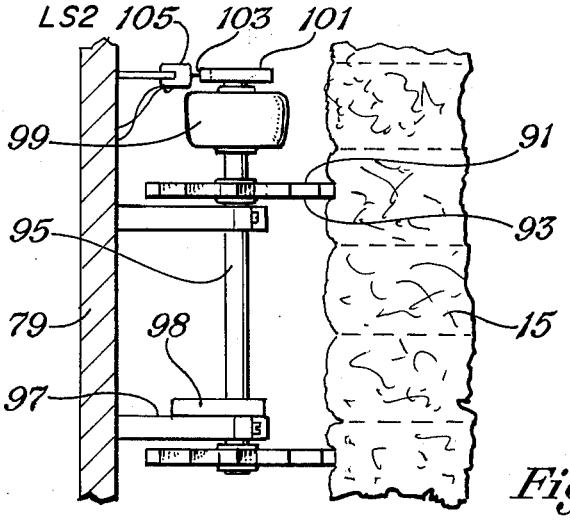
Fig.9

APPARATUS FOR COLLECTING AND DISPOSING OF REFUSE

BACKGROUND OF THE INVENTION

1. Field of the Invention

This invention relates in general to reuse collection; and, in particular, to an apparatus for collecting and disposing of city refuse.

2. Description of the Prior Art

Conventionally, homes' and small businesses' refuse is collected by a crew or crews collecting refuse over one or more route segments and depositing the refuse in a truck where the refuse is compressed. Once the truck is filled, the crew progresses to a landfill, often outside the city, where the refuse is dumped. Earth moving equipment at the landfill spread and pack the refuse, and cover with earth.

There are several disadvantages with this procedure. One is the time and transportation expenses for each of the truck and crew to transport the load to the landfill. Usually, multiple round trips per day are required for each crew, and even at fairly close distances to the landfill, a minimum of 2 hours per day for the crew of three is required for the trips.

Another disadvantage is that at the landfill, because of the loose refuse dumped by the trucks, compaction of the fill is not sufficiently dense to properly support roads and buildings that may later be built upon the fill. Also, paper and light objects are scattered during high winds.

The density of the landfill may be increased by using highly compressed bales of refuse in the landfills, and a few cities have begun utilizing permanently positioned balers at the landfill. However, this does not solve the inefficiencies of transporting the loose refuse to the landfill.

SUMMARY OF THE INVENTION

It is accordingly a general object of this invention to provide an improved apparatus for collecting and disposing of refuse.

It is also an object of this invention to provide apparatus for collecting and baling the refuse simultaneously along a plurality of route segments making up a route; discharging the bales along the route segments; informing a transport unit as to bale locations; and subsequently picking up the bales with a transport unit; thus avoiding the need for the collecting crews to convey respective truck loads of refuse to the landfill.

It is also an object of this invention to provide a portable baling unit for simultaneously collecting and baling refuse along the route, having means to convey bales to a satisfactory point along the route to be discharged for subsequent pickup.

These and further objects and advantages of this invention will become apparent from the descriptive matter hereinafter.

BRIEF DESCRIPTION OF THE DRAWINGS

FIG. 1 is a side elevational, and partly schematic, view of the portable baling unit and the transport unit illustrating the apparatus of this invention.

FIG. 2 is a partial side elevational view of the portable baling unit of this invention.

FIG. 3 is a partial top view of the compaction chute and wire guide portion of the portable baling unit of FIG. 2.

FIG. 4 is a partial vertical cross sectional view of the baling ram of the portable baling unit of FIG. 2.

FIG. 5 is a cross sectional view of the portable baling unit of FIG. 2 taken along the lines V—V.

FIG. 6 is a partial top view of the retaining means in the compaction chute of the portable baling unit of FIG. 2.

FIG. 7 is a partial top view of the extracting means and conveyor of the portable baling unit of FIG. 2.

FIG. 8 is a schematic diagram of the hydraulic and electrical circuit of the portable baling unit of FIG. 2.

FIG. 9 is a side elevational view of limit switch LS 2 of the portable baling unit of FIG. 7.

DESCRIPTION OF THE PREFERRED EMBODIMENT

With reference to FIG. 1, a portable baling unit 11 and a transport unit 13 are shown schematically. The portable baling unit 11 collects refuse by traversing along one or more of respective predetermined route segments making up a route. The refuse is simultaneously baled, and periodically bales 15 are deposited at suitable places along the route. The portable baling unit 11 and transport unit 13 have communication means 17 for advising transport unit 13 of the location of the bales 15. Transport unit 13 picks up several bales 15 from various portable baling units 11, and takes them to a refuse sink where they are deposited. The refuse sink may be a recycling center; landfill where the bales are covered with earth; or the like.

The portable baling unit 11 comprises a truck tractor 19 that provides the means for traversing along respective predetermined route segments. Tractor 19 is of conventional design and has a fifth wheel 21 that provides means for attaching the collecting and baling unit 23.

Referring to FIG. 2, the collecting and baling unit 23 is trailer mounted and provides the means for collecting and baling refuse as the portable baling unit 11 traverses along its respective route segment. The collecting and baling unit 23 has an open topped hopper collector 25, the lower walls of which form a rectangular chamber, or ram cavity, 26. The upper part 27 of the walls slopes outward to facilitate the insertion of refuse. Refuse is deposited in the hopper collector 25 similar to conventional side-loading compaction collectors.

A baling ram 29 is located in close alignment with the ram cavity 26 of hopper collector 25. The baling ram 29 is attached to a hydraulic cylinder 31 responsively connected with a power unit 33. Power unit 33 is an engine and pump capable of supplying hydraulic pressure at; for example, 3,000 pounds per square inch (psi). The cylinder 31 and power unit 33 provide ram moving means to move the ram longitudinally within the ram cavity 26. Ram 29 is retractable toward tractor 19 to a point in alignment with the upper sloping wall 27 of the hopper collector. Ram 31 is extensible to a point shortly beyond ram cavity 26. A hood 35, shown in phantom lines in FIG. 2, is rigidly connected to the top of the baling ram 29 and is reciprocally movable along with the ram 29. Hood 35 prevents refuse from falling behind ram 29 while extended and allows refuse to be continuously placed in hopper collector 25, even during compaction strokes.

A limit switch LS O is positioned in ram cavity 26 in alignment with ram 29. It will be contacted and closed only on full retraction of ram 29. Another limit switch LS 1 is positioned in ram cavity 26 in alignment with ram 29. It will be contacted and closed only on full extension of ram 29.

A ram compaction chute 37 is adjacent hopper collector 25 in line with ram 29, and of cross sectional dimensions equal to ram 29. Ram 29 extends to the entrance of the compaction chute 37 on full extension. The compaction chute 37 is rectangular, close topped, and constructed of steel plate sufficiently strong to withstand compaction forces equivalent to a hydraulic pressure adequate for compaction. FIG. 5 shows a cross sectional view of the compaction chute along lines V—V viewed toward tractor 19, with a bale 15 in place.

A structurally strong compaction gate 39 is carried at the end of the compaction chute 37 opposite hopper collector 25. Compaction gate 39 serves as the wall of the compaction chute 37 that is on the opposite end of ram 29 and against which the refuse can be compacted. Compaction gate 39 is vertically movable by hydraulic cylinders 41.

A liquid waste collection sump 43 is attached to the collecting and baling unit 23 directly below the hopper collector 25 and compaction chute 37. Apertures (not shown) are provided on the floors of the hopper collector 25 and compaction chute 37 in communication with the sump 43. Liquid waste dripped and squeezed from the refuse in the compaction chute 37 and hopper collector 25 is collected in the sump 43. A liquid storage reservoir 45 is carried by the collecting and baling unit 23 near the front. A pump 47 pumps via conduit 48 liquid waste collected in the sump 43 to reservoir 45. As shown in FIG. 8, a level switch 50 and float 52 control the level of liquid in the sump by automatically activating pump 47.

One or more retainer means 49, shown in more detail in FIG. 6, are located along each side wall 51 of the compaction chute 37. Retainer means 49 comprise a V-shaped member having two arms 53, 55 pivotally connected at their intersection to a bracket hinge 57. Bracket hinge 57 is rigidly fastened to side wall 51. Arm 53 is biased outward from side wall 51 by a coil spring 59. Arm 55 is consequently biased inward toward side wall 51, which has an aperture 61 at the point of intersection. Arm 55 has a projection 63 extending a short distance into compaction chute 37. The projection 63 has a bevel 65 on one side, the other side being perpendicular to side wall 51. Refuse being compacted by ram 29 forces the projection outward, by pressing the bevel 65, thus compressing spring 59. On retraction, or back stroke, of ram 29, the expansion of the refuse into ram cavity 26 is prevented by the perpendicular side of projection 63, thus acting like a check valve and retaining a degree of compaction.

A plurality of apertures, indicated as 67, FIGS. 2 and 3, are spaced along the forward end of the side wall 51 of compaction chute 37. Ram 29, as shown in FIG. 4, contains a plurality of passageways or slots 69, spaced transversely across its face 71. The slots 69 are wedge shaped, with the small end of the wedge open so as to prevent refuse from entering the slots. In the preferred embodiment, six rows of slots 69 in pairs are provided, or a total of twelve slots. In each pair group, one slot 69 guides new wires in, while another slot guides old wires for tying, to be explained below. Ram 29 is semi-automatically extensible to a point where slots 69 align with apertures 67. The apertures 67 and slots 69 provide guide means for guiding wires for encompassing a bale as described hereinafter.

Shown in FIGS. 3 and 5, a pair of tubes 73 are fastened on one side wall 51 of the compaction chute 37 adjacent apertures 67. These tubes hold a bundle of precut wires 75, used to encircle and tie bales 15. On the opposite side wall 51, a plurality of fastening means or hooks 77 are attached to the side wall. Hooks 77 are adjacent apertures 67 and provide means for retaining in place the ends of tie wires 75.

A storage platform for bales 15, or conveyor 79, is attached to the collecting and baling unit 23 directly behind compaction gate 39. Conveyor 79 is of width approximately equal to the compaction chute 37 and twice its length, so that two bales 15 may be carried on it.

Referring to FIGS. 7 and 8, extracting means, or continuous chain drives 81, are mounted along the sides of the conveyor 79. Conveyor 79 and chain drive 81 provide means for periodically discharging bales of refuse. Each chain drive 81 extends a substantial length along the conveyor 79 and is in alignment with bales 15 being pushed thereonto. Each chain drive 81 has a plurality of dogs 83 that will bite into a bale 15 being pushed onto conveyor 79 and draw it along.

As schematically indicated in FIG. 8, chain drive 81 is connected to a slip clutch and gear box 85. A crank 87 is provided for manual rotation. The gear box and slip clutch 85 is connected to a hydraulic motor 89 powered by fluid from power unit 33. The slip clutch 85 enables a bale 15 to be pushed into and move the chain drives 81 without resistance. After the bale is moved a selected distance, limit switch LS 2 activates motor 89 to complete extraction.

Limit switch, or limit means, LS 2 is mounted to the side wall of conveyor 79 between compaction gate 39 and chain drive 81. Limit means LS 2, as shown in FIG. 9, comprises two sprocket wheels 91 having teeth 93. Wheels 91 are connected to a shaft 95 so as to rotate in unison therewith. The shaft 95 is mounted parallel to a side wall of conveyor 79. Brackets 97 are fastened to the side wall of conveyor 79 and rotatably carry shaft 95 by bearings or bushings (not shown). A spring motor 98 effects return of the sprocket wheels 91 to a zero, or starting, position once the wheels are free of a passing bale. A gear reduction box 99 is connected to the conveyor 79 and receives one end of shaft 95. A cam 101 is connected to the output of gear reduction box 99. Cam 101 has a lobe 103 of enlarged diameter and of selected radial dimensions. A limit switch 105 is mounted in engagement with cam 101. Its backside contacts are opened and its front side contacts are closed by lobe 103. Lobe 103 is designed to close front side contacts of limit switch 105 after a selected amount of rotation, and to keep limit switch 105 closed thereafter until released for return to the starting position. As the cam rotates back toward the starting position, indicating the bale has been extracted and disengaged, the backside contacts are closed to effect closure of the retraction gate.

Brackets 97 are of length sufficient to bring wheels 91 into contact with bales 15 being pushed onto conveyor 79. Wheels 91 must be of sufficient diameter to continue contact through variances in the sides of bales. Teeth 93 bite substantially into the bale side to ensure that at least one of the wheels 91 will be in contact as the bale passes. Brackets 97 may contain springs (not shown) to force the wheels outward a sufficient distance to remain in contact with indentations in bale 15, yet compress while encountering enlarged portions along the sides to avoid placing too much strain on the limit means LS 2.

Gear reduction box 99 is at a selected ratio, depending on wheel 91 diameter and bale length, to rotate cam 101 slightly less than a full turn for the full passage of a bale 15. Limit means LS 2 and the associated components described provide means for measuring when the bale 15 is moved a predetermined distance satisfactory for activating the extracting means, and when the bale is extracted from beneath the compaction gate satisfactory for closing the compaction gate.

Referring to FIG. 2 and the schematic of FIG. 8, a photoelectric sensor unit with beam 107, is mounted near the top of ram cavity 26. A light source 109 is mounted on one side of ram cavity 26. A receiving cell 111 is mounted on the other side, the cell providing an electrical output while receiving the light beam. A timing unit 113 monitors the breaking of the signal. Timing unit 113 is a logic circuit designed to provide an output only if the light beam has been interrupted for a predetermined time interval. Short intermittent interruptions by refuse being thrown into the hopper collector 25 are insufficient to cause the timing unit 113 to give an output. When the refuse reaches a selected level, the light beam is interrupted for a relatively constant time period, thus causing the timing unit to provide an output.

The timing unit 113, FIG. 8, is connected to an actuator control 115. Actuator control 115 has a solenoid output 116 connected to a four way hydraulic valve 117. Actuator control 115 has several inputs. Inputs *a* and *b* are connected, respectively, to the auto and manual positions of a hydraulic control switch 119. Switching control switch 119 to the respective auto and manual positions supplies 12 volts to respective inputs *a* and *b*. Input *c* is connected to a restart switch 120, which is a push button type switch. Depressing restart switch 120 provides 12 volts to input *c* of the actuator control 115. Actuator control 115 also has two inputs from a pressure switch 121. Actuator control 115 has logic circuitry for actuating output solenoid 116 to change the position of hydraulic valve 117.

Hydraulic valve 117 is connected through line 123 to a hydraulic pump 124 of power unit 33. Hydraulic pump 124 is a conventional pump having relief or bypass valve 126 to the reservoir, operable at a selected maximum pressure, which in the preferred embodiment is about 3,000 psi. Another line 125 from hydraulic valve 117 on the same side is connected to a hydraulic fluid reservoir 127. On the other side, hydraulic valve 117 is connected by line 129 to pressure switch 121, which, in turn, is connected to the hydraulic cylinder 31 of ram 29 on the power stroke side of the cylinder. Hydraulic valve 117 is connected by line 131 to the hydraulic cylinder 31 of ram 29 on the retract stroke side of the cylinder.

Hydraulic valve 117 has three positions. Neutral position 133 blocks all lines. Power stroke position 135 applies pressurized fluid through line 123 and line 129 to the power stroke side of hydraulic cylinder 31, with a return to reservoir 127 being provided by line 131 and line 125. Retract stroke position 137 applies pressurized fluid through line 123 and line 131 to the retract stroke side of hydraulic cylinder 31, while fluid is returned through line 129 and line 125, thus retracting ram 29. Actuator control 115 selectively places hydraulic valve 117 in any of the three positions by retracting or extending its output solenoid 116 from the neutral position of hydraulic valve 117.

Limit switch LS O is also connected to actuator control 115 and provides a signal which causes the actuator control 115 and output solenoid 116 to return hydraulic valve 117 to neutral position 133.

Limit switch LS 1 is connected to pressure switch 121, and if activated by ram 29, provides a signal to pressure switch 121. If control switch 119 is in auto and if pressure switch 121 is below a selected pressure, the signal of LS 1 passes to a circuit of actuator control 115 which energizes solenoid 116 in the opposite direction, shifting valve 117 from power stroke position 135 to retract stroke position 137. If the pressure has achieved the preselected level, such as 2,000 psi, when LS 1 is activated, pressure switch 121 provides a signal to another circuit within actuator control 115, deenergizing solenoid 116 to return hydraulic valve 117 from power stroke position 135 to neutral position 133, thereby holding ram 29 fully extended. When the ram 29 is fully extended, slots 69 of ram 29 and apertures 67 of the compaction chute 37 are aligned, as for tying.

The manual position, effecting manual mode, on control switch 119 supplies voltage through input *b* via switch 140. Switch 140 can be switched to the R or E positions for effecting, via actuator control 115, movement of the hydraulic valve 117 to retract or extend, respectively, the ram 29. Switch 140 is spring loaded to the neutral position. This allows positioning the ram 29 as desired. Subsequent switching of control switch 119 from manual to auto supplies voltage through input *a* to a circuit within actuator control 115 shifting the hydraulic valve 135 from neutral position 133 to retract stroke position 137. Auto mode also has a connection to photoelectric sensor unit 117 to energize light source 109.

If in the auto mode of operation, and the selected pressure has been achieved, LS 1 and pressure switch 121 cause actuator control 115 to return hydraulic valve 135 into neutral position, as for tying. From this neutral position, as following tying, subsequent depression of restart switch 120 through input *c* causes actuator control 115 to shift hydraulic valve 117 into retract stroke position 137, thereafter continuing in the auto mode.

Another four way hydraulic valve 139 is connected between the hydraulic cylinder 41 of the compaction gate 39 and the hydraulic pump 124. Hydraulic valve 139 is similar to hydraulic valve 117 and has a power position 141, neutral position 143, and return position 145. Power position 141 engages pump 124 with the power, or upward, stroke side of cylinder 41, with return to reservoir 127. Neutral position 143 blocks all lines. Return position 145 applies pressurized fluid to the retraction, or downward, side of cylinder 41, with the upward stroke side returning to reservoir 127.

An actuator control 147 has a solenoid output 148 in engagement with hydraulic valve 139 to shift it from neutral position 143 to either power 141 or return 145 positions. Actuator control 147 has an input *c* from the restart switch 120. Depression of the restart switch through input *c* causes a solenoid output from actuator control 147 that shifts hydraulic valve 139 to power position 141, thereby raising compaction gate 39. Limit switches LS 3 and LS 4 are mounted in engagement with compaction gate 39, and connected to actuator control 147. Full extension actuates limit switch LS 3, which, in turn, provides a signal returning hydraulic valve 139 to neutral position 143. Full retraction activates limit switch LS 4 which provides a signal returning hydraulic valve 147 to neutral position. A third input to actuator control 147 connects actuator control 147 to limit switch LS 2. A signal from the backside contacts of LS 2 causes actuator control 147 to provide an output, shifting hydraulic valve 139 into return position 145, thereby lowering compaction gate 39.

In addition, terminal *a* from auto position of hydraulic control switch 119 is connected to actuator control 147. Voltage from auto switch terminal *a* causes actuator control 147 to shift hydraulic valve 139 from neutral to return position 145.

A third hydraulic valve 149 is connected between hydraulic pump 124 and hydraulic motor 89 of the bale extracting means. Valve 149 has two positions, one supplying pressurized fluid through input *e* and return fluid by output *d*. The other is a neutral blocking position.

An actuator control 151 has an output solenoid 152 in engagement with valve 149 to shift valve 149 between the two positions. Actuator control 151 has one input from limit switch LS 2, which provides a voltage to actuator control 151 which shifts valve 149 into power position. Discontinuance of the voltage allows valve 149 to return to its neutral position. Actuator control 151 also is connected with a manual override switch 146 which will signal actuator control 151 to run motor 89, as for manual extraction of a bale.

The transport unit 13, FIG. 1, is a conventional truck tractor pulling a flat bed trailer 155 capable of carrying a load from 50,000 to 70,000 pounds. A loading arm 157 is mounted to trailer 155 for picking up bales. Loading arm 157 is capable of lifting 4,000 pounds, and may be moved along trailer 155 in order to reach all points on the trailer.

The following flow diagram illustrates the method steps that are employed to perform this invention, utilizing the above described apparatus.

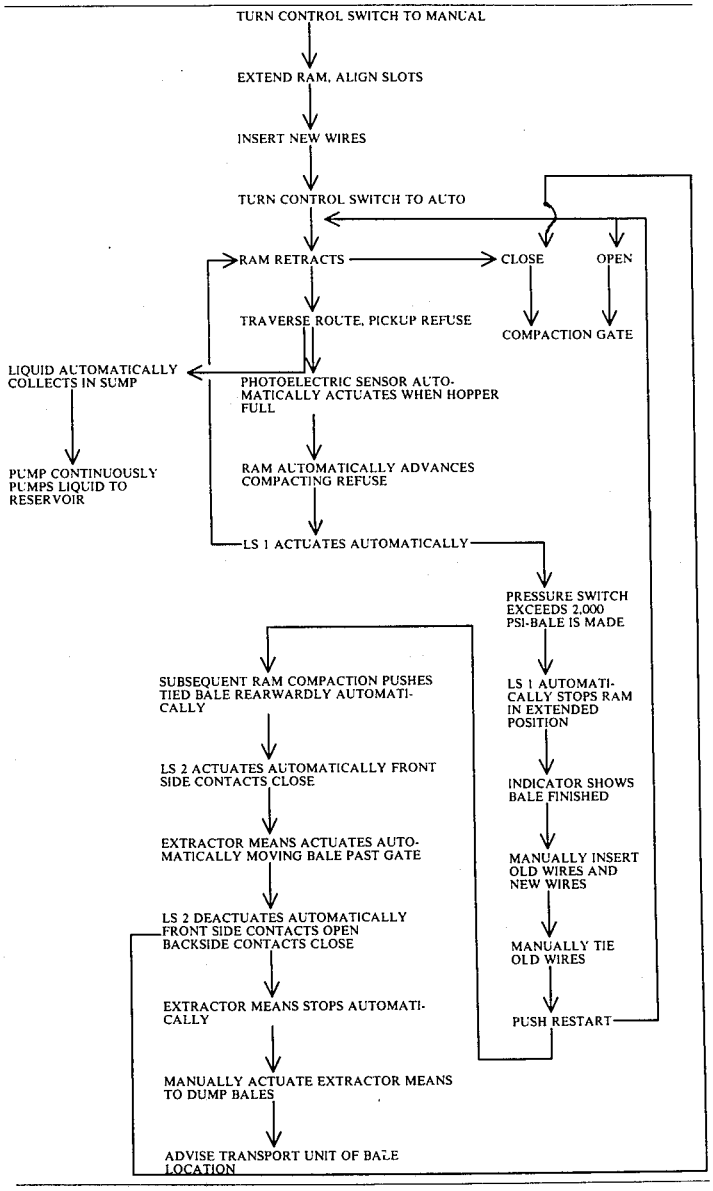

The detailed operation is as follows. At the start of each day, the power supply is started and control switch 119 is turned to manual. Manual extend switch E is actuated which actuates control 115, shifting hydraulic valve 117 to power position 135, extending ram 29 to its fully extended position.

At this position, slots 69 will be in alignment with apertures 67 in the compaction chute 37. The operator then manually draws forth a wire 75 from tube 73 and threads it through the slot and out the aperture on the other side. The end of each wire 75 is temporarily placed over hooks 77. In the preferred embodiment, six wires are inserted at spaced intervals.

Control switch 119 is then turned to auto, applying voltage to actuator control 115 which shifts hydraulic valve 117 into retract position 137. Ram 29 retracts until it trips limit switch LS O, which signals actuator control 115 to shift hydraulic valve 117 into neutral position. Often compacting gate 39 is left remaining up from cleaning at the end of the previous day. Consequently, turning control switch 119 to auto also applies voltage to actuator control 147 at input *a*, shifting hydraulic valve 139 into return position 145, lowering the gate 39, if it is up.

The portable baling unit 23 is then driven around its predetermined route segment and refuse picked up and placed in hopper collector 25 in a normal manner. As refuse is thrown in, photoelectric sensor beam 107 is interrupted, but the interruption time is insufficient to trigger an output from timing unit 113. Once the refuse fills ram cavity 26 below the hopper collector 25 to a depth which interrupts photoelectric sensor beam 107 for a selected period of time, for example, greater than 2 seconds, timing unit 113 provides an output to actuator control 115, which energizes solenoid 116, shifting hydraulic valve 117 into power stroke position 135. Ram 29 advances, pushing refuse into compaction chute 37. It also begins pushing the six wires 75 toward the rear of compaction chute 37. Collection of refuse and depositing it in the hopper collector 25 may proceed normally, since hood 35 advances with the ram 29. On retraction, refuse will be pushed off the hood 35 into the floor of ram cavity 26 of hopper collector 25.

Once ram 29 trips LS 1, at full extension, a signal is provided to pressure switch 121. If pressure switch 121 is below 2,000 psi when it receives this signal, as it would be on the initial stroke, actuator control 115 shifts hydraulic valve 117 to retract position, effecting retraction of ram 29. Once ram 29 reaches LS O, valve 117 is shifted to neutral. Pressure switch 121 provides measuring means for measuring when a predetermined compaction force is reached on compaction of the refuse.

Independently during pickup and compaction strokes, liquid wastes are dripped through the floor to sump 43. Pump 47 continuously pumps the liquid to reservoir 49.

After several stroke cycles, compaction chute 37 will be completely full, wires 75 wrapped around three sides, and stroke pressure will eventually exceed 2,000 psi. If hydraulic pressure reaches 2,000 psi prior to ram 29 reaching LS 1, the signal effected by closure of LS 1 will be transmitted from pressure switch 121 to another circuit within actuator control 115, which shifts hydraulic valve 117 to neutral, holding ram 29 in the extended position. The closure of LS 1 also energizes via the other circuit from pressure switch 121 a lamp 122 inside the tractor cab 19 to indicate to the operator that a bale is finished. The lamp serves as means for advising an operator to tie off the bale when the compaction force is reached and the ram stops extended.

In the extended position, slots 69 of ram 29 are aligned automatically with apertures 67 of compaction chute 37. An operator manually draws the free end of each wire 75 from the tube 73 and inserts each through the respective slots 69 aligned with the end which was placed over hook 77. The operator also draws forth new wires 75 and inserts them through the other pair of each of the six rows of slots 69. The ends of the old wires 75 are then securely tied together, and the inserted end of the new wires 75 placed over hooks 77. Bale 15 is ready to be removed from compaction chute 37, and the end view is shown in FIG. 5.

The operator then pushes restart switch 120, which supplies voltage to actuator control 147, whose solenoid 148 shifts hydraulic valve 139 into power position 141. Compaction gate 39 raises, and upon being fully open, contacts LS 3, shifting hydraulic valve 139 into neutral position 143 and holding gate 39 open. Restart switch 120, actuator control 147, hydraulic valve 139, and hydraulic cylinder 41 provide means for opening the compaction gate 39. Restart switch 120 also supplies voltage to actuator control 115, shifting hydraulic valve 117 in retract position 137, retracting ram 29. Once fully retracted, ram 29 contacts LS O, returning hydraulic valve 117 back to neutral position 133. Collecting and compaction cycle then proceeds normally.

When photoelectric sensor beam 107 once again triggers ram 29 advancement, the previously completed bale 15 will be pushed rearward toward the conveyor 79 by the new refuse. As shown in FIG. 9, the sides of completed bale 15 engage wheels 91 and LS 2, rotating cam 101. Shortly thereafter, the sides of completed bale 15 engage the chain drive 81 which freewheels because of slip clutch 85. Once cam 101 has rotated a selected degree which corresponds to a desired lineal movement of bale 15, the front side contacts of limit switch 105 are closed. The desired lineal movement is that distance sufficient for a selected number of dogs 83 of the chain drive 81 to bite into the bale 15. Closing of limit switch 105 provides voltage to actuator control 151, which, in turn, shifts hydraulic valve 149 into power position, energizing motor 89. Motor 89 turns the chain drive 81, extracting completed bale 15 completely onto the conveyor 79. As indicated hereinbefore, once the bale is past the sprocket wheels 91, LS 2 is rewound to the start position, opening the front side contacts of limit switch 105 and closing the backside contacts thereof. This indicates that bale 15 is no longer in engagement with LS 2 and is clear of the compaction gate 39. Opening of the front side contacts of limit switch 105 automatically causes actuator control 151 to return hydraulic valve 149 to neutral position, deenergizing motor 89. Closure of the backside contacts provides a one-shot signal to actuator control 147, which shifts hydraulic valve 139 to its return position, effecting closing of the compaction gate 39. Thus, limit switch LS 2 provides limit means for activating and deactivating the extractor means and for measuring when the bale is moved from beneath the compaction gate 39.

When the bale compaction cycle is completed a second time, the operators tie the second bale, and proceed normally collecting refuse for a third bale. The second completed bale will be extracted as was the first. After two bales are being carried by conveyor 79, the operators look for a suitable place to temporarily store the completed bales 15. A suitable place might be on a street not heavily travelled, alongside the curb. To dump the bales, initially a plastic sheet is spread to catch any leakage of liquids. Manual override switch 146 of the extractor means turns on the hydraulic motor 89, ejecting the bales onto the plastic sheet. The operator radios the transport unit, informing the transport unit operator of the location of the completed bales.

The completed bales are fairly heavy and large, ranging from 1,000 to 2,000 pounds, and compressed to a density of 25–40 pounds per cubic foot. A typical bale size might be 3 by 3 by 6 feet. The transport unit is capable of carrying 50,000 to 70,000 pounds, thus may carry 15–30 bales per trip to the refuse sink or landfill. The transport unit deposits the bales closely stacked at the landfill, and after a sufficient depth is reached, a cover of earth is applied. No spreading, tamping or packing is necessary.

The last bale of the day can be removed from the collecting and baling unit 23 with manual override and with suitably pry bar between the ram 29 and the bale 15.

It should be apparent from the foregoing that significant improvements for refuse collecting are provided by this invention.

The collecting truck does not need to make the normal two or three round trips per day to the landfill as with conventional refuse collecting. This saves transportation expenses as well as man hours, since two of the three man crew are not needed during the trips to the landfill. The refuse will be collected more quickly since the transport unit which takes the bales to the landfill will carry refuse being collected from as many as five collecting and baling units. The baled refuse being stacked at the landfill will be more dense, conserving space, and providing a better landfill.

The step of advising of the transport unit may be done by having prearranged locations at which the bales are deposited and of which the operator(s) of the transport unit is advised by maps or the like.

The portable baling unit 23 has been illustrated as separate tractor and baler units.

If desired, liquid level control may be employed in liquid sump 43, as illustrated by reference numerals 50 and 52 in FIG. 8, to turn the pump on and off and control the liquid level therein.

Any number of tubes 73 for holding wires 75 may be employed.

Also, rather than having a neutral position in hydraulic valves 117,139 extended and retracted positions may be held under continuing pressure from pump 124.

In addition, ram 29 may be actuated by any other suitable means.

Moreover, the tying of the bales may be automated.

Although this invention has been described with a certain degree of particularity, it is understood that the present disclosure has been made only by way of example and that numerous changes in the details of construction may be resorted to without departing from the scope of this invention.

What is claimed is:

1. A combination for collecting and disposing of refuse comprising:

a. a plurality of portable baling units, each including:

i. first means for traversing along respective predetermined route segments;

ii. second means for collecting and baling refuse as said portable baling unit traverses along its respective route segment; said second means being connected with said first means; and iii. third means for periodically discharging bales of refuse; said third means being responsively connected with said second means and separably operable;

said second and third means comprising a hopper collector, a ram cavity therebeneath, a ram compaction chute, a ram that is movable longitudinally of said ram cavity and said compaction chute, a compaction gate for closing over the end of said compaction chute for forming a bale, a reciprocally movable hood that is connected with said ram so as to move reciprocally therewith and protect said ram by preventing refuse from falling thereinto behind said ram during a compaction stroke of said ram; wire guide means for guiding wire for encompassing a bale and for tying said wire about a compacted said bale; retainer means for retaining a degree of compaction achieved by said ram; said retainer means being disposed in said compaction chute so as to engage compacted refuse before it reenters said ram cavity underneath said hopper on the backstroke of said ram to receive additional refuse; a liquid waste collection sump disposed beneath said hopper, ram cavity and compaction chute for collecting liquid waste; a reservoir for receiving said liquid waste; and a pump connected with said sump and with said reservoir for transporting said liquid waste from said sump to said reservoir; a control switch; said control switch being operable to automatic position to effect automatic operation, automatically effecting retraction of said ram and closure of said compaction gate to start a particular route segment and refuse collection; a photoelectric sensor unit with beam in said ram cavity for monitoring the degree of refuse collection effected including a timing unit for monitoring the breaking of said beam for a predetermined time interval to indicate refuse stacked beyond a certain level and to signal automatic compaction stroke of said ram; ram moving means for effecting a compaction stroke of said ram; said ram moving means being connected responsively with a power unit and said photoelectric sensor unit; first limit switch means for limiting movement of said ram on said compaction stroke and effecting retraction of said ram; said first limit switch means being drivingly connected with said ram moving means; whereby compaction cycling continues automatically until a predetermined force is reached; compaction force measuring means for measuring when said predetermined compaction force is reached on compaction of said refuse means for advising an operator to complete a bale when said compaction force is reached; means for opening said compaction gate; means for extracting a bale after it has been pushed from said compaction chute by compaction of refuse thereagainst a predetermined distance; second limit means for measuring when said bale is moved a predetermined distance satisfactory for activating the extracting means and when the bale is extracted from beneath the compaction gate for closing the compaction gate; said second limit means being connected with said compaction gate closing means and said extracting means; and b. a transport unit that picks up said bales of refuse discharged by said portable baling units and delivers said bales to a sink;

whereby said transport unit with only a few trips to a refuse sink can serve said plurality of portable baling units, without requiring many trips by said plurality of portable baling units, each with a plurality of personnel.

* * * * *